United States Patent [19]

Lehrer et al.

[11] Patent Number: 4,556,932

[45] Date of Patent: Dec. 3, 1985

[54] LIGHTED NOVELTY ITEM

[76] Inventors: Bradley D. Lehrer, 32405 First Place S., Federal Way, Wash. 98003; Daniel A. Rivisto, 8237 - 4th NE., Seattle, Wash. 98115

[21] Appl. No.: 481,146

[22] Filed: Mar. 28, 1983

[51] Int. Cl.[4] ..... F21L 15/08; F21L 7/00; F21V 11/00

[52] U.S. Cl. ..... 362/103; 362/104; 362/191; 362/200; 362/205; 362/800; 362/806; 362/355; 200/60; 40/10 R

[58] Field of Search ..... 362/200, 201, 103, 104, 362/186, 205, 800, 806, 355, 326, 311, 206, 295, 191, 109; 40/555, 574, 575, 489; 200/60, 153 LA

[56] References Cited

U.S. PATENT DOCUMENTS

| | | | |
|---|---|---|---|
| 2,206,865 | 7/1940 | David et al. | 362/200 X |
| 2,374,375 | 4/1945 | O'Donnell | 362/104 X |
| 3,423,865 | 1/1969 | Hardesty et al. | 40/454 |
| 3,609,899 | 10/1971 | Alexander et al. | 40/121 |
| 3,739,512 | 6/1973 | Ruppert | 40/130 K |
| 3,863,246 | 1/1975 | Trcka et al. | 40/137 |
| 4,112,482 | 9/1978 | Powell | 362/201 X |
| 4,130,859 | 12/1978 | Battarel | 362/205 |
| 4,180,931 | 1/1980 | Osch | 40/219 |
| 4,211,955 | 7/1980 | Ray | 362/800 X |
| 4,254,333 | 3/1981 | Bergstrom | 250/221 |
| 4,296,459 | 10/1981 | Deluca | 362/104 |
| 4,329,737 | 5/1982 | Triller et al. | 362/32 |
| 4,414,611 | 11/1983 | Seltzer et al. | 362/200 X |

FOREIGN PATENT DOCUMENTS

| | | |
|---|---|---|
| 2937086 | 5/1981 | Fed. Rep. of Germany . |

*Primary Examiner*—Stephen C. Bentley
*Assistant Examiner*—John S. Maples
*Attorney, Agent, or Firm*—Christensen, O'Connor, Johnson & Kindness

[57] ABSTRACT

A battery-powered, self-contained lighted novelty item incorporates a removable face plate. A square, transparent area formed on the center of the face plate is superimposed over a prism shaped lens within the novelty item. An electrical circuit including a light emitting diode is included within the novelty item to illuminate the transparent area on the face plate. A design or figure applied to the face plate, and in particular to the transparent area on the center of the face plate, will be illuminated when the electrical circuit is completed and the light emitting diode is energized.

16 Claims, 6 Drawing Figures

LIGHTED NOVELTY ITEM

BACKGROUND OF THE INVENTION

This invention relates to small novelty items, and more particularly to a battery-powered, lighted novelty item usable as a brooch, a badge, a belt buckle, or other ornamental article.

Certain novelty items such as round pins or belt buckles are configured to bear slogans or phrases to convey messages either in the form of advertisements or just as a form of expression by the wearer. One drawback of such novelty items is that the message imprinted on the pin or belt buckle cannot be read at night, or in other situations of low light levels, thereby limiting the usefulness of such items.

Therefore, one object of this invention is to provide a lighted novelty item that will illuminate or backlight a figure or words imprinted on the face of the novelty item. Another object of this invention is to provide a lighted novelty item that incorporates a flashing light source. A further object of this invention is to provide a lighted novelty item that can be configured for use as a brooch, a belt buckle, or other type of decorative item.

SUMMARY OF THE INVENTION

The foregoing objects and other objects that will become apparent to one of ordinary skill upon reading and following specification are realized in a battery-powered, lighted novelty item including a rectangularly shaped housing and a lighting unit mounted within the housing. The housing has side and end walls and an integral back wall. A continuous lip formed around the periphery of the housing extends forwardly from adjacent the forward edge of the side and end walls. A removable face plate forms the front side of the housing and is held by an interference fit within the forwardly extending lip. A rectangular, transparent area is centered on the face plate.

The lighting unit within the housing includes a mounting board that is oriented parallel to and located adjacent a first end wall of the housing. A light emitting diode element is attached to the mounting board and is part of an electrical circuit formed on the mounting board. Two electrical contacts on the mounting board are configured for contact with batteries used to power the light emitting diode element. One surface of a prism-shaped lens mounts to the light emitting diode element for transmitting light emitted by the element. Another surface of the lens is positioned adjacent the transparent area of the face plate so that light passing into the lens illuminates the transparent area. The lighted novelty item also includes a contact apparatus for providing a continuous electrical circuit between the ends of the batteries installed in the novelty item. A switch apparatus for opening and closing the electrical circuit is also provided.

In the preferred embodiment, two batteries are used to provide an electrical current to the light emitting diode element. When the electrical circuit of the novelty item is completed, the light emitting diode element is energized and illuminated. The light produced by the light emitting diode is transmitted through the lens to illuminate the rectangularly shaped transparent area in the center of the face plate. Any design or figure on the transparent area is thus illuminated. Another feature of the preferred embodiment is an electrical circuit that is configured to cause the light emitting diode to flash in a periodic manner.

DETAILED DESCRIPTION

Figure 1:
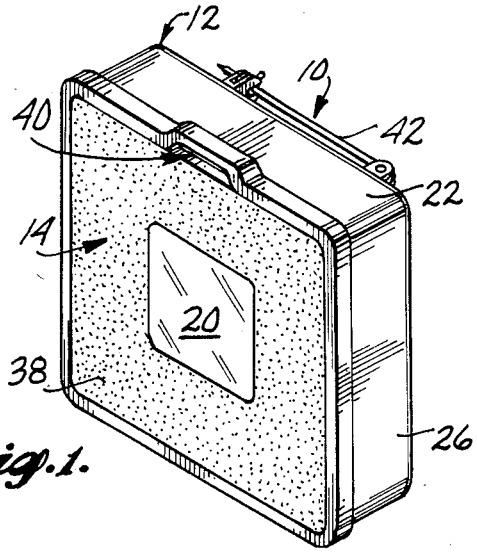
FIG. 1 is a perspective view of the lighted novelty item configured for use as a brooch.
Figure 2:
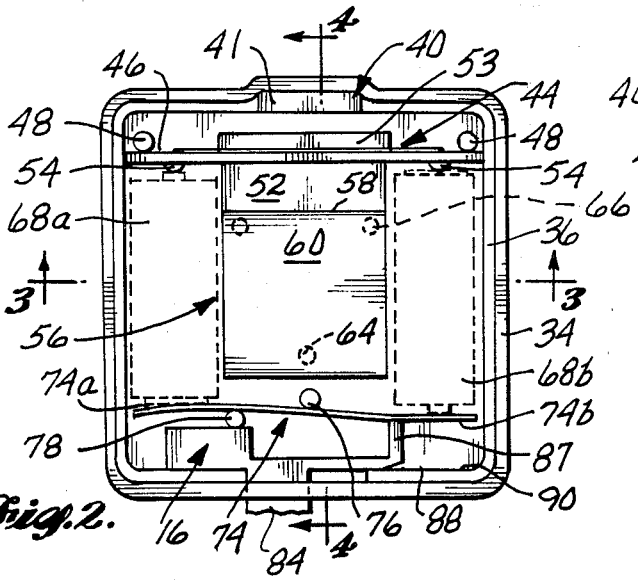
FIG. 2 is a plan view of the lighted novelty item with the face plate removed illustrating its internal construction.

FIGS. 1 and 2 illustrate a battery-powered, lighted novelty item 10 that includes a housing 12 having a rectangular face plate 14. A switch 16 (FIG. 2) is used to complete an electrical circuit within novelty item 10 for illumination of a transparent area 20 formed on face plate 14.

Figure 4:
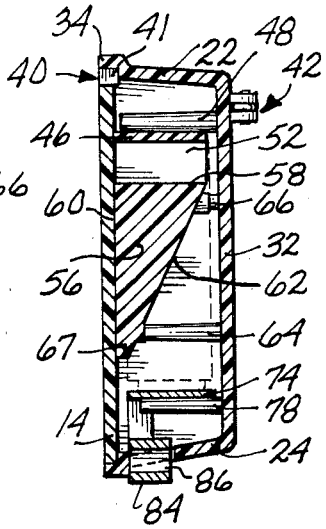
FIG. 4 is a cross-sectional view of the lighted novelty item taken along section line 4—4 of FIG. 2 with the face plate installed.
Figure 3:
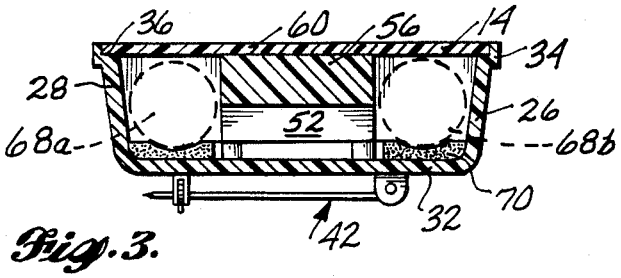
FIG. 3 is a cross-sectional view of the lighted novelty item taken along section line 3—3 of FIG. 2 with the face plate installed.

Looking at the construction of novelty item 10 in more detail, housing 12 is a one-piece, rectangularly shaped polyhedron. In the preferred embodiment, housing 12 is injection molded from a styrene polymer or some other inexpensive, easily formed polymer having sufficient structural strength. Housing 12 is formed with first and second end walls 22 and 24, and first and second side walls 26 and 28. As best shown in FIGS. 3 and 4, side and end walls 22, 24, 26, and 28 of the preferred embodiment of housing 12 are angled outwardly slightly to permit easy removal from a mold. The rear edge of end and side walls 22, 24, 26, and 28 joins a back wall 32 that forms the rear surface of housing 12. A continuous lip 34 extends forwardly from adjacent the forward edge of end and side walls 22, 24, 26, and 28 and surrounds the outer periphery of housing 12. The inwardly facing surface of lip 34 is spaced outwardly from the inner surface of the end and side walls. A shoulder 36 is thus formed by the forward edge of end and side walls 22, 24, 26, and 28, the outer edge of which is defined by lip 34.

Face plate 14 is substantially planar in configuration and is injection molded from a styrene polymer or some other polymer that is transparent when solidified. The outer dimensions of face plate 14 are sized to fit within the inner surface of lip 34 and are held by an interference fit within lip 34 when the face plate abuts shoulder 36. A square, transparent area 20 is centered on face plate 14 with a border region 38 surrounding the transparent area. Border region 38 is made opaque by applying an opaque material such as paint to the outer surface of face plate 14. In the preferred embodiment, a design, figure, or alphanumeric indicia are then applied to the front surface of face plate 14 by silk screening or some other suitable process. The portion of the printed material that is to be illuminated or highlighted by backlighting is positioned over transparent area 20.

Referring to FIGS. 1, 2, and 4, a pry slot 40 is formed in lip 34 adjacent first end wall 22 and spaced equally from both side walls 24 and 26. A section of lip 34 that protrudes outwardly from the adjoining portions of the lip forms pry slot 40. A shallow recess 41 having a width approximately equal to the width of pry slot 40 is formed in shoulder 36 (FIGS. 2 and 3). Pry slot 40 and recess 41 are sized to allow insertion of an object such as a fingernail or screwdriver blade behind face plate 14 to remove it from housing 12.

In the embodiment of novelty item 10 illustrated by FIGS. 1, 3, and 4, a pin clasp 42 is attached to the outer surface of back wall 32. Pin clasp 42 can be used to attach novelty item 10 to a shirt, jacket, or hat as a slogan pin or brooch. It is to be understood that the outer surface of back wall 32 can be modified to form a belt buckle, a clasp for a string tie, and into various other configurations so that novelty item 10 can be used in a variety of ways. As an alternative, some type of stand arrangement can be affixed to the outer surface of back wall 32 to allow novelty item 10 to be used as a free standing article.

Referring now to FIGS. 2, 3, and 4, the internal components of novelty item 10 include a lighting unit 44 mounted to the inner surface of back wall 32. Lighting unit 44 is used to illuminate transparent area 20 of face plate 14. Lighting unit 44 includes a substantially planar mounting board 46 having a length to width ratio substantially greater than unity. Mounting board 46 is positioned with a lengthwise edge adjacent back wall 32 within housing 12 so that a flat surface of the mounting board abuts two alignment posts 48 that orient mounting board 46 orthogonally relative to the back wall. Alignment posts 48 are integrally molded as part of back wall 32 and extend forwardly perpendicular to the back wall. One alignment post 48 is located in each of the corners of housing 12 adjacent first end wall 22.

A light emitting diode (LED) pack 52 is attached to mounting board 46 and provides the light source for novelty item 10. LED pack 52 is rectangularly shaped and houses eight individual light emitting diodes (not shown). LED pack 52 is connected to the surface of mounting board 46 away from first end wall 22. Lead wires (not shown) extend from the surface of LED pack 52 that abuts mounting board 46 and are wired into an electrical circuit 53 formed on the mounting board. Electrical circuit 53 can be a printed circuit formed on mounting board 46 or a hard wired circuit. A battery contact 54 located near each end of mounting board 46 forms the terminal ends of electrical circuit 53. In the preferred embodiment, electrical circuit 53 includes components that cause LED pack 52 to flash in a periodic manner when electrical circuit 53 is connected to a power source. LED pack 52 is constructed so that the surface of the LED pack remote from mounting board 46 is illuminated when the LED pack is energized. LED pack 52 is a commercially available component such as the part manufactured by the Hewlett-Packard Corporation of Palo Alto, Calif., under part number HLMP-2685. As known to those skilled in the art, light emitting diodes currently available emit a red, green, or yellow light. Any of these colors can be used in novelty item 10.

The final element of lighting unit 44 is a lens 56 that transmits the light produced by LED pack 52. In the preferred embodiment, lens 56 is injection molded from a styrene polymer and has a right triangular prism shape. The surface of lens 56 has a frosted, translucent finish to aid in the diffusion of light transmitted by the lens. A first surface 58 of lens 56 is affixed to the surface of LED pack 52 remote from mounting board 46 with an adhesive that allows the transmission of light therethrough. A second surface 60, oriented orthogonally to first surface 58, is positioned adjacent the center of face plate 14 (FIGS. 3 and 4) and in abutment therewith. Second surface 60 has a square configuration with an area equal in size to transparent area 20. Thus, when LED pack 52 is energized and transmits light through lens 56, the entire transparent area 20 is illuminated.

As best shown in FIG. 4, lighting unit 44 is attached to housing 12 by affixation of an angled surface 62 of the lens 56 to a long mounting post 64 and a pair of short mounting posts 66. In the preferred embodiment, all of the mounting posts are integrally formed as part of back wall 32 and project forwardly therefrom in an orthogonal orientation. Long mounting post 64 is centered laterally between side walls 26 and 28 and is located toward second end wall 24 from a centerline between the two end walls. Short mounting posts 66 are positioned to support the corners of lens 56 adjacent LED pack 52. The differential in length of the mounting posts accomodates the slope of angled surface 62 of lens 56. The forward ends of mounting posts 64 and 66 abut flattened projections 67 molded into angled surface 62. In the preferred embodiment, lens 56 is affixed to mounting posts 64 and 66 by use of an adhesive, though other means of attachment may be used. By attaching lens 56 to the mounting posts, lighting unit 44 is held securely within housing 12.

When seen in a plan view as in FIG. 2, lens 56 of lighting unit 44 is centered longitudinally within housing 12. The spaces formed between the sides of lens 56 and first and second side walls 26 and 28 are sized to accommodate a battery **68*a* and 68*b* (shown in phantom lines) on each side of the lens. The batteries used in novelty item 10 are identical to one another, but have been given different reference numerals to aid in the description that follows. Batteries 68*a* and 68*b* provide the power to energize LED pack 52. A thin foam pad 70 is affixed to back wall 32 on either side of lens 56 to form a cushioned bed for each battery 68*a* and 68*b*. As in a conventional battery-powered device, when batteries 68*a* and 68*b* are inserted in novelty item 10, a positive pole of one battery and a negative pole of the other battery are in contact with battery contacts 54 on mounting board 46**.

The ends of batteries **68*a* and 68*b* remote from mounting board 46 are electrically connected to one another by a contact strip 74 that extends substantially the width of housing 12. In the preferred embodiment, contact strip 74 is a strip of metal that is held with a lengthwise edge adjacent back wall 32 by first and second locater pins 76 and 78. Specifically, strip 74 is held orthogonally relative to back wall 32. Pins 76 and 78 are integrally formed with back wall 32 and extend forwardly therefrom in an orthogonal relationship. First locater pin 76 is longitudinally aligned with and spaced toward second end wall 24 from long mounting post 64. Second locater pin 78 is spaced laterally and longitudinally from first locater pin 76. Locater pins 76 and 78 are positioned to allow one end of contact strip 74 to flex longitudinally within housing 12. A first end 74*a* of contact strip 74 is spaced laterally from second locater pin 78 and is positioned to contact the end of battery 68*a*. When the electrical circuit of novelty item 10 is open, the second end 74*b* of contact strip 74 is spaced away from a position in which it can contact the end of battery 68*b***.

Switch 16 completes and breaks the electrical circuit of novelty item 10 by urging contact strip 74 against the end of battery 68*b*. The body of switch 16 is a one piece component that is injection moldd from a styrene polymer or some other inexpensive, easy-to-mold polymer. Switch 16 slides against the inner surface of second end wall 24. A lever 84 projects outwardly from the middle portion of switch 16 and extends through a slot 86 that is centrally formed in second end wall 24. Lever 84 is used to actuate switch 16 from outside novelty item 10. Switch 16 also includes an arm 87 that is formed at the end of switch 16 adjacent battery 68*b*. Arm 87 extends toward first end wall 22 and rests against contact strip 74. The end of switch 16 remote from arm 87 is configured to slide against second locater pin 78 and thereby use the locater pin as a guide for the switch.

When switch 16 is in the "off" position, the switch is located closest to second side wall 28. To urge contact strip 74 against the end of battery 68*b* and thereby complete an electrical circuit to energize LED pack 52, switch 16 is moved toward first side wall 26 to an "on" position. A notch 88 is formed in switch 16 at the end of arm 87 remote from contact strip 74. When switch 16 reaches the end of its travel into the "on" position, notch 88 rides atop a ramp 90 formed on the inner surface of second end wall 24, thereby urging arm 87 inwardly toward battery 68*b*. When arm 87 is pushed away from second end wall 24 in this manner, contact strip 74 is positively urged against the end of battery 68*b* to complete the electrical circuit of lighting unit 44 and energize LED pack 52.

Figure 5:
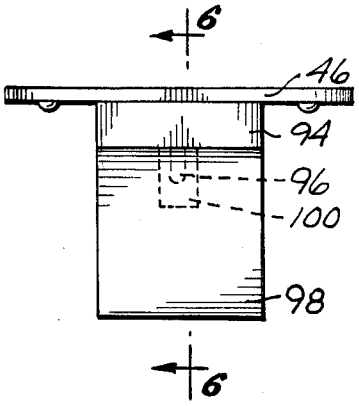
FIG. 5 shows an alternate embodiment of the lighting unit used within the lighted novelty item; and, FIG. 6 is a cross-sectional view of the alternate embodiment of the lighting unit taken along section line 6—6 of FIG. 5.
Figure 6:
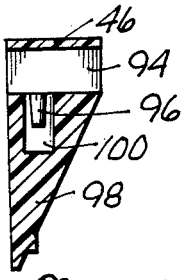

An alternate embodiment for lighting unit 44 is illustrated in FIGS. 5 and 6. In this alternate embodiment, a light emitting diode pack 94 having only a single light emitting diode 96 is attached to mounting board 46 in a manner similar to the attachment of LED pack 52. In this embodiment, the single light emitting diode 96 extends outwardly from LED element 94 away from mounting board 46. To accommodate light emitting diode 96, a lens 98 having a right triangular prism shape has a cavity 100 formed in the surface of the lens that abuts LED pack 94. Cavity 100 is sized to house diode 96. Lens 98 is attached to LED element 94 as in the preferred embodiment. The use of a single light emitting diode will decrease the amount of current needed by the lighting unit.

The present invention has been described in relation to a preferred embodiment and variations upon that embodiment. One of ordinary skill, after reading the foregoing specification, will be able to effect various changes, alterations, and substitutions of equivalents without departing from the broad concepts disclosed. For example, while the embodiment of the novelty item disclosed herein was described as using a flashing light source, a light source that is continuously illuminated can also be used. It is therefore intended that the scope of Letters Patent granted hereon be limited only by the definitions contained in the appended claims and equivalents thereof.

The embodiments of the invention in which an exclusive property or privilege is claimed are defined as follows:

1. A battery powered, lighted novelty item, comprising:

a housing, said housing have a rectangular configuration with first and second side walls that are spaced away from one another and first and second end walls that are spaced away from one another, said housing having a back wall joining the rear edge of said side and end walls, said housing having a lip extending forwardly from the outer surface of said side and end walls to form a shoulder along the forward edge of said side and end walls;

a face plate, said face plate being substantially planar and having substantially flat marginal edges complementary to and tightly frictionally engaging the inner surface of said lip when said face plate abuts said shoulder, said face plate having a transparent area positioned thereon;

a lighting unit, said lighting unit being mounted within said housing and affixed to said back wall, said lighting unit including a mounting board, said mounting board being substantially planar with a length and width, said mounting board oriented substantially parallel to and positioned adjacent said first end wall of said housing, said mounting board including an electrical circuit attached thereto, said electrical circuit including first and second electrical contacts for abutting the terminals of said battery used to power said lighting unit, said lighting unit including light means attached to said mounting board and connected to said electrical circuit for providing a source of illumination within said novelty item, said lighting unit also including a lens, said lens having a prism configuration with a first surface attached to said light means, said lens having a second surface that abuts said face plate, said lens being positioned in the center of said face and sized to allow said transparent area of said face plate to superimpose said second surface; and contact means for providing a continuous electrical circuit between said first and second electrical contacts on said mounting board when said battery is installed in said novelty item, said contact means including a switch means for opening and closing the electrical circuit of said novelty item.

2. The novelty item defined by claim 1, wherein said light means includes a light emitting diode.

3. The novelty item defined by claim 2, wherein said electrical circuit is configured and arranged to cause said light emitting diode to flash in a periodic manner when the electrical circuit of said novelty item is energized and complete.

4. The novelty item defined by claim 3, wherein said contact means includes a metallic contact strip located intermediate said mounting board and said second end wall, said contact strip extending from said first to said second side wall and positioned to contact a pole of a battery inserted into said novelty item.

5. The novelty item defined by claim 4, wherein said switch means includes a switch member interposed between said contact strip and said second end wall, said switch member configured for sliding engagement with said second end wall between an off position and an on position, said switch member including a lever portion extending outwardly through an aperture formed in said second end wall and an arm extending toward said first end wall, said arm having an end remote from said switch member that touches said contact strip, said switch means including a notch formed in said switch member on the surface abutting said second end wall, said notch being aligned with said arm, said switch means also including a ramp on said inner surface of said second end wall, said ramp being positioned to engage said notch when said switch member is moved to said on position, said notch and said ramp coordinating to urge said arm toward said first end wall.

6. The novelty item defined by claim 5, wherein said lip on said housing includes a protruding area to form a pry slot for removing said face plate from said housing.

7. The novelty item defined by claim 6, further comprising a clasp pin affixed to the outer surface of said back wall.

8. A battery powered, lighted novelty item, comprising:

a housing, said housing having a front face, said front face having a transparent portion therein, said housing having a rear face connected to said front face by a surrounding side wall, said front and rear faces and said side wall defining a cavity within said housing;

means associated with said housing for gaining access to said cavity;

a lighting unit, said lighting unit being mounted within said housing, said lighting unit including a substantially planar mounting board having a length to width ratio substantially greater than unity, said mounting board being positioned with a longitudinal edge adjacent said rear face of said housing with said mounting board oriented orthogonally relative to said rear face, said mounting board including an electrical circuit attached thereto, said electrical circuit including first and second electrical contacts for abutting the terminals of said battery used to power said lighting unit, said lighting unit including light means attached to said mounting board and connected to said electrical circuit for providing a source of illumination within said novelty item, said lighting unit also including a lens, said lens having a prism configuration with a first surface attached to said light means, said lens having a second surface that abuts said front face, said lens being positioned adjacent said transparent portion of said front face and sized to allow said transparent portion to superimpose said second surface; and contact means for providing a continuous electrical circuit between said first and second electrical contacts on said mounting board when said battery is installed in said novelty item, said contact means including a switch means for opening and closing the electrical circuit of said novelty item.

9. The novelty item defined by claim 8, wherein said light means includes a light emitting diode.

10. The novelty item defined by claim 9, wherein said electrical circuit is configured and arranged to cause said light emitting diode to flash in a periodic manner when the electrical circuit of said novelty item is energized and complete.

11. The novelty item defined by claim 10, wherein said contact means includes a metallic contact strip located within said cavity, said contact strip being movable between a first position wherein said contact strip would not contact a battery inserted in said novelty item and a second position wherein said contact strip would contact a pole of a battery inserted into said novelty item.

12. The novelty item defined by claim 11, wherein said switch means includes a switch member positioned adjacent said contact strip within said cavity, said switch member configured for sliding movement between an off position corresponding to said first position of said contact strip and an on position corresponding to said second position of said contact strip, said switch member including a lever portion extending outwardly through an aperture formed in said side wall and an arm extending toward and in contact with said contact strip, said arm having an end remote from said switch member that touches said contact strip, said switch means including a notch formed in said switch member on a surface away from said arm, said notch being aligned with said arm, said switch means also including a ramp on said inner surface of said side wall, said ramp being positioned to engage said notch when said switch member is moved to said on position, said notch and said ramp coordinating to urge said arm toward said contact strip.

13. The novelty item defined by claim 12, further comprising a clasp pin affixed to the outer surface of said rear face of said housing.

14. A battery powered, lighted novelty item, comprising:

a housing, said housing have a rectangular configuration with first and second side walls that are spaced away from one another and first and second end walls that are spaced away from one another, said housing having a back wall joining the rear edge of said side and end walls, said housing having a lip extending forwardly from the outer surface of said side and end walls to form a forwardly exposed shoulder along the forward edge of said side and end walls, a portion of said lip along said first end wall protruding outwardly in a direction away from said second end wall to space the inner surface of said lip away from said shoulder and form a pry slot on said first end wall, said shoulder adjacent said pry slot having a rearwardly extending recess that extends below surface of the shoulder;

a face plate, said face plate being substantially planar and having substantially flat marginal edges complementary to and tightly frictionally engaging the inner surface of said lip when said face plate abuts said shoulder, said face plate having a transparent area positioned thereon;

lighting means located within said housing for illuminating said transparent area on said face plate; and switch means for turning said lighting means on and off.

15. The novelty item defined by claim 14, wherein said switch means includes:

a metallic contact strip extending from said first to said second side walls, said contact strip being movable between a first position wherein said contact strip would not contact a pole of a battery inserted in said novelty item and a second position where said contact strip would contact a pole of a battery inserted in said novelty item; and a switch member interposed between said contact strip and said second end wall, said switch member configured for sliding engagement with said second end between an off position corresponding to said first position of said contact switch and an on position corresponding to said second position of said contact strip, said switch member including a lever portion extending outwardly through an aperture formed in said second end wall and an arm extending toward said first end wall, said arm having an end extending toward said first end wall that touches said contact strip, said switch member including a notch formed on the surface abutting said second end wall, said notch being aligned with said arm; and a ramp formed on said inner surface of said second end wall, said ramp being positioned to engage said notch on said switch member when said switch member is moved to said on position, said notch and said ramp coordinating to urge said arm towards said first wall.

16. The novelty item defined by claim 15, further comprising a clasp pin affixed to the outer surface of said back wall.

* * * * *